US010209732B2

(12) United States Patent
Cook

(10) Patent No.: US 10,209,732 B2
(45) Date of Patent: Feb. 19, 2019

(54) BANDGAP REFERENCE CIRCUIT WITH TUNABLE CURRENT SOURCE

(71) Applicant: Allegro MicroSystems, LLC, Manchester, NH (US)

(72) Inventor: Aaron Cook, Deerfield, NH (US)

(73) Assignee: Allegro MicroSystems, LLC, Manchester, NH (US)

( * ) Notice: Subject to any disclaimer, the term of this patent is extended or adjusted under 35 U.S.C. 154(b) by 100 days.

(21) Appl. No.: 15/071,298

(22) Filed: Mar. 16, 2016

(65) Prior Publication Data

US 2017/0269627 A1 Sep. 21, 2017

(51) Int. Cl.

| | |
|---|---|
| ***G05F 3/30*** | (2006.01) |
| ***G05F 3/26*** | (2006.01) |
| *G05F 1/565* | (2006.01) |
| *G05F 1/575* | (2006.01) |

(52) U.S. Cl.

CPC ..... *G05F 3/267* (2013.01); *G05F 1/565* (2013.01); *G05F 1/575* (2013.01); *G05F 3/30* (2013.01)

(58) Field of Classification Search

CPC . G05F 3/30; G05F 1/565; G05F 1/575; G05F 3/267

See application file for complete search history.

(56) References Cited

U.S. PATENT DOCUMENTS 4,317,054 A * 2/1982 Caruso ..... G05F 3/30 323/313
5,051,686 A * 9/1991 Schaffer ..... G05F 3/30 323/313
6,211,661 B1 * 4/2001 Eckhardt ..... G05F 3/245 323/314
7,170,274 B2 * 1/2007 Mukherjee ..... G05F 3/30 323/313
7,268,529 B2 * 9/2007 Mochizuki ..... G05F 3/30 323/314
7,437,260 B2 * 10/2008 Ausserlechner ..... G01L 5/0047 323/293

(Continued)

OTHER PUBLICATIONS

Johns et al. "Analog Integrated Circuit design", ISBN, 0-471-14448-7, Dec. 13, 2011, John Wiley & sons, Inc., pp. 357-359, 3 pages.

(Continued)

*Primary Examiner* — Jue Zhang
*Assistant Examiner* — Jye-June Lee
(74) *Attorney, Agent, or Firm* — Daly, Crowley, Mofford & Durkee, LLP

(57) ABSTRACT

A bandgap reference circuit includes a voltage reference circuit configured to generate a reference voltage at a first output and a proportional to absolute temperature (PTAT) current source configured to generate a PTAT current reference at a second output. A divider circuit is coupled to the reference voltage and configured to generate a divided reference voltage at a third output of the bandgap reference circuit. The bandgap reference circuit further includes a tunable current source coupled to the divider circuit and configured to generate a tunable current reference at a fourth output of the bandgap reference circuit based, at least in part, on the divider circuit. A method of generating a tunable current with a bandgap circuit is also provided.

18 Claims, 2 Drawing Sheets

(56) References Cited

U.S. PATENT DOCUMENTS

| | | | | |
|---|---|---|---|---|
| 8,089,260 | B2 * | 1/2012 | Yang | G05F 3/30 323/313 |
| 2010/0128154 | A1 * | 5/2010 | Xu | G05F 3/30 323/313 |
| 2011/0068854 | A1 * | 3/2011 | Engl | G05F 3/30 327/512 |
| 2012/0081099 | A1 * | 4/2012 | Melanson | G05F 3/30 323/313 |
| 2015/0227156 | A1 * | 8/2015 | Kobayashi | G05F 3/16 323/268 |

OTHER PUBLICATIONS

Gray et al. "Analysis and Design of Analog Integrated Circuits," Fourth Edition, Feb. 15, 2001, John Wiley & sons, Inc., pp. 307-309, 3 pages.

* cited by examiner

BANDGAP REFERENCE CIRCUIT WITH TUNABLE CURRENT SOURCE

CROSS REFERENCE TO RELATED APPLICATIONS

Not Applicable.

STATEMENT REGARDING FEDERALLY SPONSORED RESEARCH

Not Applicable.

FIELD

This disclosure relates generally to bandgap reference circuits, and more particularly, to a bandgap reference circuit including a tunable current reference.

BACKGROUND

As is known, voltage and current reference circuits are frequently used in a variety of electronic circuits (e.g., integrated circuits). Analog, digital, and mixed-signal electronic circuits, for example, require voltage and/or current reference circuits for providing high precision, stable reference voltages and/or currents. A bandgap voltage reference circuit is one example of a voltage reference circuit that is widely used to provide a reference voltage that remains substantially constant over a range of temperature, supply voltage, and load variations.

SUMMARY

Described herein are concepts, systems, circuits and techniques related to a bandgap reference circuit and a method of generating a tunable current with such a bandgap reference circuit. More particularly, a bandgap reference circuit capable of providing at least a reference voltage, a proportional to absolute temperature (PTAT) current reference, a divided reference voltage and a tunable current reference (i.e., an adjustable current reference) is provided. A current level of the tunable current reference may be tuned by selection of a resistance associated with a resistor ladder of a divider circuit including at least two resistors of a first resistor type (e.g., a p-type resistor) and a resistance associated with at least one parallel-coupled resistor of the divider circuit of a second resistor type, different than the first resistor type (e.g., an n-type resistor).

The bandgap reference circuit and method of generating a tunable current with such a bandgap reference circuit disclosed herein may be suitable, for example, in sensing circuits (e.g., magnetic field sensing circuits), driver circuits (e.g., LED driver circuits or motor driver circuits) and substantially any other circuit in which a reference voltage, a PTAT current reference, a divided reference voltage and/or a tunable current reference is desirable.

In one aspect of the concepts described herein, a bandgap reference circuit includes a voltage reference circuit including a first transistor having a first junction voltage and a second transistor having a second junction voltage, the voltage reference circuit configured to generate a reference voltage at a common control node coupled to the first and second transistors. The reference voltage is based, at least in part, on a voltage difference between the first junction voltage and the second junction voltage, and is provided at a first output of the bandgap reference circuit. The bandgap reference circuit also includes a proportional to absolute temperature (PTAT) current source configured to generate a PTAT current reference at a second output of the bandgap reference circuit based, at least in part, on a current through the first transistor.

The bandgap reference circuit additionally includes a divider circuit coupled to the reference voltage and configured to generate a divided reference voltage having a voltage value that is a fraction of a voltage value of the reference voltage, the divided reference voltage provided at a third output of the bandgap reference circuit. The bandgap reference circuit further includes a tunable current source coupled to the divider circuit and configured to generate a tunable current reference at a fourth output of the bandgap reference circuit based, at least in part, on the divider circuit.

The bandgap reference circuit may include one or more of the following features individually or in combination with other features. The bandgap reference circuit may include an amplifier stage having a first input coupled to the first transistor, a second input coupled to a common control node of the first and second transistors, and an output coupled to a common drain stage. The tunable current source may be coupled to a first terminal of the common drain stage and the divider circuit may be coupled to a second terminal of the common drain stage at which the reference voltage is provided. The divider circuit may include a resistor ladder coupled between the first output of the bandgap reference circuit and a reference potential and have an intermediate node at which the divided reference voltage is provided.

The divider circuit may include at least one resistor coupled in parallel with the resistor ladder. The resistor ladder may include at least two resistors having a temperature coefficient of a first polarity and the at least one parallel-coupled resistor may have a temperature coefficient of a second polarity. One of the at least two resistors of the resistor ladder and the at least one parallel-coupled resistor may include an n-type resistor, and the other one of the at least two resistors of the resistor ladder and the at least one parallel-coupled resistor may include a p-type resistor. A current level of the tunable current reference may be tunable by selection of a resistance associated with the resistor ladder and a resistance associated with the at least one parallel-coupled resistor, and a temperature coefficient of the tunable current reference may be tunable by adjusting a ratio of the resistance associated with the resistor ladder with respect to the resistance associated with the at least one parallel-coupled resistor. The current level of the tunable current reference may be substantially flat over temperature and a supply voltage. The common drain stage may be a field effect transistor (FET).

In another aspect of the concepts described herein, a method of generating a tunable current with a bandgap circuit includes providing a bandgap reference voltage, and dividing the bandgap reference voltage with a resistor ladder including at least two resistors of a first resistor type. The method also includes coupling at least one resistor in parallel with the resistor ladder, the at least one parallel-coupled resistor being of a second resistor type, different than the first resistor type. The method additionally includes providing a current reference, and tuning a current level of the current reference by selection of a resistance associated with the resistor ladder and a resistance associated with the at least one parallel-coupled resistor. The method further includes tuning a temperature coefficient of the current reference by adjusting a ratio of the resistance associated with the resistor ladder with respect to the resistance associated with the at least one parallel-coupled resistor.

The method may include one or more of the following features either individually or in combination with other features. Dividing the bandgap reference voltage with a resistor ladder including at least two resistors of a first resistor type may include dividing the bandgap reference voltage with a resistor ladder including at least two resistors having a temperature coefficient of a first polarity. Coupling at least one resistor in parallel with the resistor ladder may include coupling at least one resistor having a temperature coefficient of a second polarity in parallel with the resistor ladder. Tuning a current level of the current reference may include tuning the current level of the current reference to be substantially flat over temperature and a supply voltage. One of the at least two resistors of the resistor ladder and the at least one parallel-coupled resistor may include an n-type resistor, and the other one of the at least two resistors of the resistor ladder and the at least one parallel-coupled resistor may include a p-type resistor.

BRIEF DESCRIPTION OF THE DRAWINGS

The foregoing features of the disclosure, as well as the disclosure itself may be more fully understood from the following detailed description of the drawings, in which.

DETAILED DESCRIPTION

Figure 1:
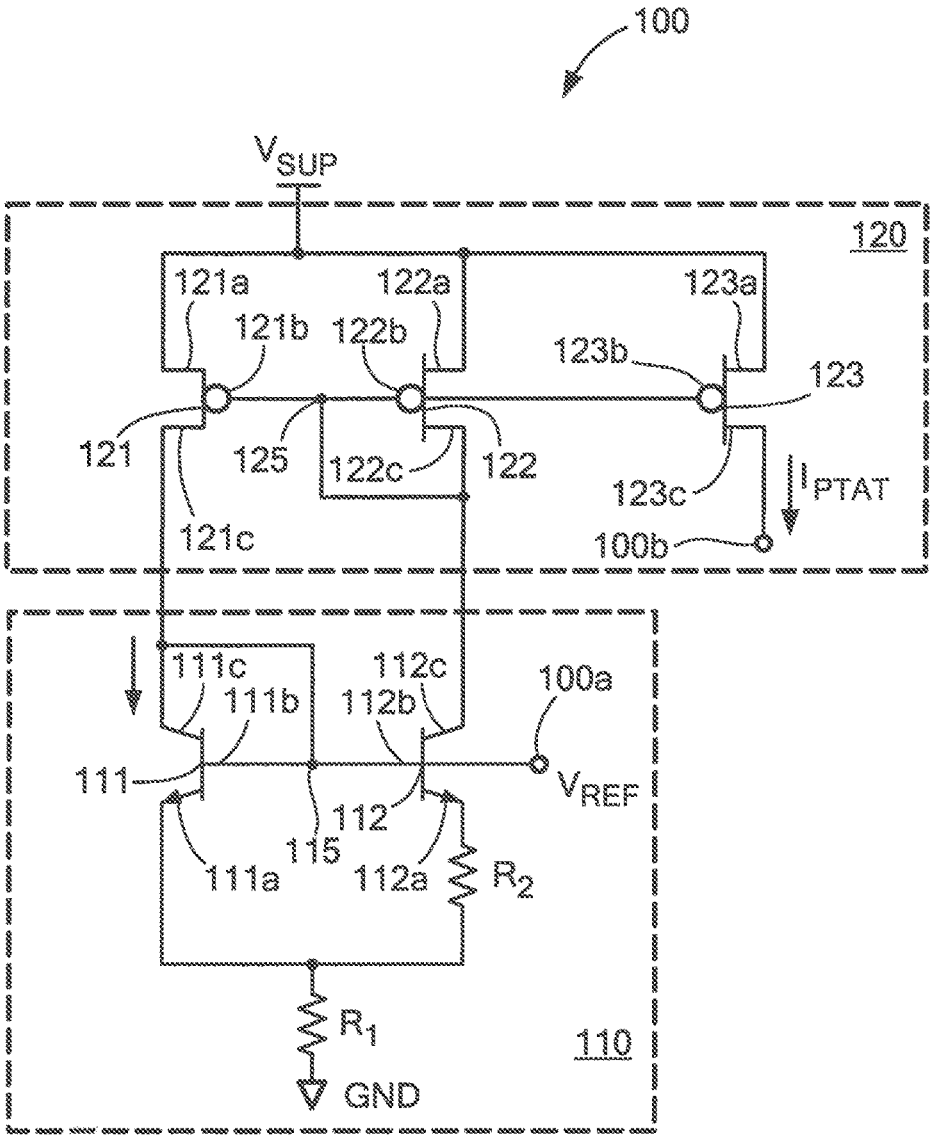
FIG. 1 (Prior Art)
FIG. 1 is a block diagram of an example prior art bandgap reference circuit.

The features and other details of the concepts, systems, and techniques sought to be protected herein will now be more particularly described. It will be understood that any specific embodiments described herein are shown by way of illustration and not as limitations of the disclosure and the concepts described herein. Features of the subject matter described herein can be employed in various embodiments without departing from the scope of the concepts sought to be protected. Embodiments of the present disclosure and associated advantages may be best understood by referring to the drawings, where like numerals are used for like and corresponding parts throughout the various views. It should, of course, be appreciated that elements shown in the figures are not necessarily drawn to scale. For example, the dimensions of some elements may be exaggerated relative to other elements for clarity.

For convenience, certain introductory concepts and terms used in the specification are collected here.

As used herein, the term "processor" or "controller" is used to describe an electronic circuit that performs a function, an operation, or a sequence of operations. The function, operation, or sequence of operations can be hard coded into the electronic circuit or soft coded by way of instructions held in a memory device. A "processor" can perform the function, operation, or sequence of operations using digital values or using analog signals.

In some embodiments, the "processor" or "controller" can be embodied, for example, in a specially programmed microprocessor, a digital signal processor (DSP), or an application specific integrated circuit (ASIC), which can be an analog ASIC or a digital ASIC. Additionally, in some embodiments the "processor" or "controller" can be embodied in configurable hardware such as field programmable gate arrays (FPGAs) or programmable logic arrays (PLAs). In some embodiments, the "processor" or "controller" can also be embodied in a microprocessor with associated program memory. Furthermore, in some embodiments the "processor" or "controller" can be embodied in a discrete electronic circuit, which can be an analog circuit, a digital circuit or a combination of an analog circuit and a digital circuit.

Additionally, it should be appreciated that, as used herein, relational terms, such as "first," "second," "top," "bottom," "left," "right," and the like, may be used to distinguish one element (e.g., a circuit) or portion(s) of an element (e.g., an output of a circuit) from another element or portion(s) of the element without necessarily requiring or implying any physical or logical relationship or order between such elements.

Referring now to FIG. 1, an example prior art bandgap reference circuit 100 includes a voltage reference circuit 110 and a proportional to absolute temperature (PTAT) current source 120. The bandgap reference circuit 100 has a first output 100*a* at which at an output (e.g., a reference voltage $V_{REF}$) of the voltage reference circuit 110 is provided and a second output 110*b* at which an output (e.g., a PTAT current reference $I_{PTAT}$) of the PTAT current source 120 is provided.

The voltage reference circuit 110 includes a first transistor 111, a second transistor 112, and resistors $R_1$ and $R_2$. The first transistor 111, which is a bipolar junction transistor (BJT), has a first terminal 111*a* (e.g., an emitter terminal) coupled to a resistors $R_1$ and $R_2$ and the second transistor 112, which is also a BJT, has a first terminal 112*a* (e.g., an emitter terminal) coupled to resistor $R_2$, as shown. Resistors $R_1$ and $R_2$, are of the same or similar resistor type (e.g., a p-type resistor or an n-type resistor) and have a same or similar temperature coefficient.

A second terminal 111*b* (e.g., a base terminal) of transistor 111 is coupled to a second terminal 112*b* (e.g., a base terminal) of transistor 112 and to a third terminal 111*c* (e.g., a collector terminal) of the transistor 111, as shown. The second terminals 111*b*, 112*b* of transistors 111, 112 form a common control node 115 at which the reference voltage $V_{REF}$ is provided to.

The proportional to absolute temperature (PTAT) current source 120 includes a first transistor 121, a second transistor 122, and a third transistor 123 coupled in a current mirror arrangement. Transistors 121, 122, and 123, which are field effect transistors (FETs), each have a corresponding first terminal 121*a*, 122*a*, 123*a* (e.g., a source terminal) coupled to a power supply, $V_{sup}$, and second terminals 121*b*, 122*b*, 123*b* (e.g., gate terminals) coupled to a common control node 125. Transistor 122 is coupled to the voltage reference circuit 110 such that the current through the transistor 122 is established based on resistors $R_1$ and $R_2$. The PTAT current reference $I_{PTAT}$ is provided by the current mirrored in transistor 123, as shown.

The reference voltage $V_{REF}$ is provided at the output 100*a* by combining a first voltage having a first temperature dependence with a second voltage having a second, substantially opposite temperature dependence (i.e., a complementary temperature dependence) such that when the first and second voltages are combined, the temperature dependence of the voltages substantially cancel. More particularly, the reference voltage $V_{REF}$ is a weighted sum of a PTAT voltage (i.e., a voltage that is substantially proportional to absolute temperature) and a complementary to absolute temperature or "CTAT" voltage (i.e., a voltage that complementary to the PTAT voltage ($V_{PTAT}$), such that the reference voltage $V_{REF}$ is substantially independent of temperature variations. The weighted sum may, for example, be based on a ratio of the current densities of the first and second transistors 111, 112 such that the PTAT behavior of the bandgap reference circuit 100 compensates for the CTAT behavior of the bandgap reference circuit 100 and provides for a reference voltage temperature coefficient of substantially zero.

In the illustrated embodiment, the PTAT voltage ($V_{PTAT}$), which has a first temperature dependence (e.g., a positive temperature dependence), is provided as a voltage difference between a first junction voltage associated with the first transistor 111 and a second junction voltage associated with the second transistor 112. The first junction voltage may, for example, correspond to a voltage (e.g., a base-emitter junction voltage $V_{BE}$) across first and second terminals 111*a*, 111*b* (i.e., base-emitter terminals) of the first transistor 111 and be proportional to a current through the first transistor 111 (as may be provided by the PTAT current source 120). The second junction voltage may correspond to a voltage (e.g., a base-emitter junction voltage $V_{BE}$) across first and second terminals 112*a*, 112*b* (i.e., base-emitter terminals) of the second transistor 112 and be proportional to a current through the second transistor 112 (as may also be provided by the PTAT current source 120). It follows that the voltage difference (i.e., $V_{PTAT}$) may correspond to a so-called "delta $V_{BE}$ voltage" ($\Delta V_{BE}$). $\Delta V_{BE}$ is equal to a voltage across resistor $R_2$ which, along with resistor $R_1$, is selected to provide a reference voltage that is substantially temperature independent.

The CTAT voltage ($V_{CTAT}$), which has a second temperature dependence (e.g., a negative temperature dependence), is provided as a junction voltage associated with one of the transistors 111, 112. The reference voltage $V_{REF}$, which is a weighted sum of $V_{PTAT}$ and $V_{CTAT}$, as noted above, is provided at the common control node 115 and at the second output 100*a* of the bandgap reference circuit 100.

The PTAT current source 120, which is coupled to the power supply, the voltage reference circuit 110 and the second output 100*b* of the bandgap reference circuit 100, provides a current reference $I_{PTAT}$ that is proportional to absolute temperature at the second output 100*b* of the bandgap reference circuit 100. The PTAT current reference is based, at least in part, on a current (e.g., a collector current) through the first transistor 111 which is equal to the above-described PTAT voltage (or $V_{PTAT}$) divided by the resistance of resistor $R_2$.

The prior art bandgap reference circuit 100 provides a single reference voltage $V_{REF}$ and a PTAT current reference $I_{PTAT}$ having a single current level at first and second outputs 100*a*, 100*b* of the bandgap reference circuit 100, respectively. Thus, in electronic circuits that require a plurality of reference voltages and/or a plurality of current references, the bandgap reference circuit 100 alone may be insufficient. Such electronic circuits typically require a plurality of voltage reference circuits and/or a plurality of current reference circuits (e.g., a plurality of bandgap reference circuits) for providing a respective plurality of reference voltages and/or a plurality of current references. The use of multiple bandgap reference circuits can be costly, particularly with respect to valuable integrated circuit space.

Figure 2:
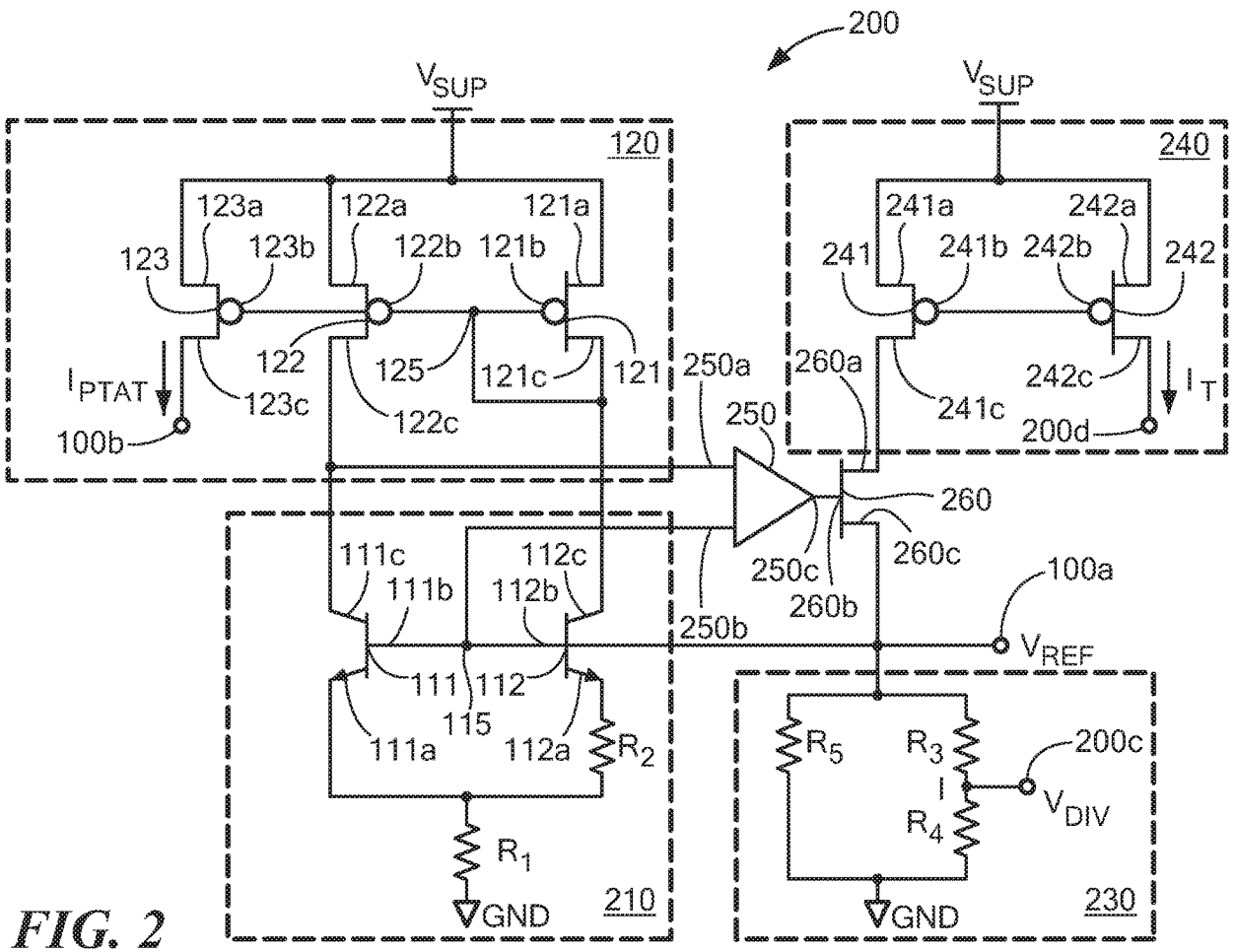
FIG. 2 is a block diagram of an example bandgap reference circuit according to the disclosure.

Referring to FIG. 2, in which like elements of FIG. 1 are shown having like reference designations, an example bandgap reference circuit 200 according to the disclosure includes a voltage reference circuit 210, the proportional to absolute temperature (PTAT) current source 120, a divider circuit 230 and a tunable current source 240. The bandgap reference circuit 200 also includes an amplifier stage 250 and a common drain stage 260 in the illustrated embodiment.

The bandgap reference circuit 200 has a first output 100*a* at which a reference voltage $V_{REF}$ is provided, a second output 100*b* at which a PTAT current reference $I_{PTAT}$ is provided, a third output 200*c* at which a divided reference voltage $V_{DIV}$ is provided and a fourth output 200*d* at which a tunable current reference $I_T$ is provided.

The divider circuit 230, which is illustrative of one example configuration of a divider circuit according to the disclosure, includes a resistor ladder having at least two series-coupled resistors (here, resistors $R_3$ and $R_4$) of a first resistor type. The first resistor type may, for example, correspond to a type of resistor having a temperature coefficient of a first polarity. The divided reference voltage $V_{DIV}$ is provided at an intermediate node I of the resistor ladder.

The divider circuit 230 also includes at least one resistor (here, resistor $R_5$) of a second resistor type, different than the first resistor type, coupled in parallel with the resistor ladder in the illustrated embodiment. The second resistor type may, for example, correspond to a type of resistor having a temperature coefficient of a second polarity. In one embodiment, the resistors of the resistor ladder (here, resistors $R_3$ and $R_4$) comprise n-type resistors and the parallel-coupled resistor $R_5$ is a p-type resistor. Alternatively, the resistors $R_3$ and $R_4$ may be p-type resistors and the parallel-coupled resistor $R_5$ may be an n-type resistor.

The tunable current source 240, which is illustrative of one example configuration of a tunable current source according to the disclosure, includes a first transistor 241 and a second transistor 242 coupled in a current mirror arrangement. The first transistor 241 and the second transistor 242, which are each PMOS field effect transistors (FETs) in the illustrated embodiment, each have a corresponding first terminal 241*a*, 242*a* (e.g., a source terminal) coupled to the power supply $V_{sup}$, and second terminals 241*b*, 242*b* (e.g., gate terminals) coupled together. The second transistor 242 has a third terminal 242*c* (e.g., a drain terminal) coupled to the fourth output 200*d* of the bandgap reference circuit 200 at which the tunable current reference $I_T$ is provided.

The bandgap reference circuit 200 also includes the amplifier stage 250 and the common drain stage 260 in the illustrated embodiment. The amplifier stage 250 has a first input 250*a* coupled to transistor 111, a second input 250*b* coupled to common control node 115 of the first and second transistors 111, 112, and an output 250*c* coupled to the common drain stage 260. The common drain stage 260 has a first terminal 260*a* coupled to the tunable current source 240, a second terminal 260*b* coupled to amplifier stage output 250*c*, and a third terminal 260*c* coupled to reference voltage $V_{REF}$ and divider ciruit 230. In one embodiment, the amplifier stage 250 is an operational transconductance amplifier (OTA). Additionally, in one embodiment, the common drain stage 260 is an NMOS field effect transistor (FET).

The voltage reference circuit 210 operates in a manner similar to the voltage reference circuit 110 of FIG. 1 to provide a reference voltage $V_{REF}$ at the first output 100*a* of the bandgap reference circuit 200 and the PTAT current source 120 operates in a manner similar to the PTAT current reference 120 of FIG. 1 to provide the PTAT current reference $I_{PTAT}$ at the second output 100*b* of the bandgap reference circuit 200. Here however, unlike bandgap reference circuit 100, the bandgap reference circuit 200 additionally provides a divided reference voltage at the third output 200*c* and a tunable current reference at the fourth output 200*d*. The foregoing may, for example, alleviate the need for additional reference circuits (e.g., bandgap-based reference circuits) and duplicate circuit components as may be required in conventional arrangements.

More particularly, the divider circuit 230 is coupled to the reference voltage $V_{REF}$ and configured to generate a divided reference voltage $V_{DIV}$ at the third output 200*c* of the bandgap reference circuit. The divided reference voltage has a voltage value that is a fraction of a voltage value of the reference voltage and may be represented by $V_{DIV}=V_{REF}\times(R_4/(R_3+R_4))$. It follows that the voltage value of the divided reference voltage may be tuned (i.e., increased or decreased) by changing a ratio of the resistances of resistors $R_3$ and $R_4$.

In one embodiment, at least one of the at least two resistors of the resistor ladder $R_3$, $R_4$ and the at least one parallel-coupled resistor $R_5$ may be provided as a variable resistor (e.g., a potentiometer), with the voltage value of the divided voltage based, at least in part, on a resistance value associated with the variable resistor(s). In embodiments in which each of resistors $R_3$, $R_4$ and $R_5$ are provided as variable resistors, the voltage value of the divided voltage (and a current level of the tunable current reference $I_T$, as will be discussed) may, for example, be adjusted (or tuned) by controlling the resistance values associated with one or more of the variable resistors. The resistance value(s) associated with the variable resistor(s) may, for example, be controlled through manual adjustment or digital adjustment as may be provided by a controller.

The tunable current source 240 is coupled to a supply voltage $V_{SUP}$ and configured to provide the tunable current reference $I_T$ at the fourth output 200*d* of the bandgap reference circuit 200. The tunable current reference $I_T$ is based, at least in part, on the divider circuit 230 with current flow between third terminal 241*c* of transistor 241 of the tunable current source 240 and the divider circuit 230 based on the amplifier stage 250 and the common drain stage 260 in the illustrated embodiment. In one embodiment, a current level of the tunable current reference $I_T$ is based on the resistor ladder and the at least one parallel-coupled resistor in the divider circuit 230.

In particular, the current level of the tunable current reference $I_T$, which is substantially constant or flat over temperature and a supply voltage in one embodiment, is tunable (i.e., increased or decreased) by selection of a resistance associated with the resistor ladder (here, a resistance associated with resistors $R_3$ and $R_4$) with and a resistance associated with the at least one parallel-coupled resistor (here, a resistance associated with resistor $R_5$). As such, the tunable current reference $I_T$ may be represented by $I_T=V_{REF}/(R_5\|(R_3+R_4))$ or $I_T=V_{REF}(R_3+R_4+R_5)/(R_3R_5+R_4R_5)$.

A temperature coefficient of the tunable current reference $I_T$ may also be tunable (e.g., tuned to be substantially constant or flat) by adjusting a ratio of the resistance associated with the resistor ladder (e.g., resistances of resistor $R_3$ and $R_4$) of the divider circuit 230 with respect to the resistance associated with the at least one parallel-coupled resistor $I_T$ (e.g., resistance of resistor $R_5$) of the divider circuit 230.

It will be appreciated that circuit cost and space efficiencies are realized by the configuration of bandgap reference circuit 200 and in particular, by the use of dividing resistors $R_3$ and $R_4$ for setting the level and temperature coefficient of the current tunable reference $I_T$ in addition to setting the level of divided reference voltage $V_{DIV}$.

It should be appreciated that the bandgap reference circuit 200 described above is but one of many potential configurations of bandgap reference circuits in accordance with the concepts, systems, circuits and techniques described herein. As one example, the transistors, both bipolar and FETs, shown herein as npn, pnp or NMOS, PMOS, respectively, can alternatively be other transistor types.

For example, while the bandgap reference circuit 200 is shown as providing a single divided reference voltage $V_{DIV}$ in the illustrated embodiment, it should be appreciated that the bandgap reference circuit 200 can provide more than a single divided voltage is some embodiments. For example, divider circuit 230 of bandgap reference circuit 200 may include additional resistors and nodes at which additional divided voltages may be provided. In other words, additional resistors may be added to the resistor ladder of the divider circuit 230 to create multiple divided bandgap based reference voltages. Additionally, the bandgap reference circuit 200 may include additional divider circuit resistor ladders which may be coupled in parallel with the resistor ladder of divider circuit 230 to receive the divided voltage and configured provide one or more additional divided voltages (e.g., second, third, fourth, etc. divided voltages) at corresponding additional outputs of the bandgap reference circuit 200.

Furthermore, while portions of the bandgap reference circuit 200 are shown within dotted line boxes, it will be appreciated that these delineations are included for ease of illustration and explanation of the circuit features only. Additionally, while the bandgap reference circuit 200 may be provided in the form of a circuit of discrete analog components as shown, it will be appreciated that in some embodiments one or more portions of the bandgap reference circuit 200 may be provided as part of a controller (not shown). The controller can, for example, perform the function, operation, or sequence of operations of one or more portions of the bandgap reference circuit 200. Further, some of the illustrated circuit functions of the bandgap reference circuit 200 can be implemented on separate circuits (e.g., additional substrates within the same integrated circuit package, or additional integrated circuit packages, and/or on circuit boards).

As described above and as will be appreciated by those of ordinary skill in the art, embodiments of the disclosure herein may be configured as a system, method, or combination thereof. Accordingly, embodiments of the present disclosure may be comprised of various means including hardware, software, firmware or any combination thereof.

It is to be appreciated that the concepts, systems, circuits and techniques sought to be protected herein are not limited to use in a particular application but rather, may be useful in substantially any application where it is desired to have a reference voltage, a PTAT current reference, a divided reference voltage and/or a tunable current reference.

Having described preferred embodiments, which serve to illustrate various concepts, structures and techniques, which are the subject of this patent, it will now become apparent to those of ordinary skill in the art that other embodiments incorporating these concepts, structures and techniques may be used. Additionally, elements of different embodiments described herein may be combined to form other embodiments not specifically set forth above.

Accordingly, it is submitted that that scope of the patent should not be limited to the described embodiments but rather should be limited only by the spirit and scope of the following claims.

What is claimed is:

1. A bandgap reference circuit, comprising:

a voltage reference circuit comprising a first transistor having a first junction voltage and a second transistor having a second junction voltage, wherein the voltage reference circuit is configured to generate a reference voltage at a common control node coupled to the first and second transistors, the reference voltage based, at least in part, on a voltage difference between the first junction voltage and the second junction voltage, wherein the reference voltage is provided at a first output of the bandgap reference circuit;

a proportional to absolute temperature (PTAT) current source configured to generate a PTAT current reference at a second output of the bandgap reference circuit based, at least in part, on a current through the first transistor;

a divider circuit connected to the common control node and configured to generate a divided reference voltage having a voltage value that is a fraction of a voltage value of the reference voltage, wherein the divided reference voltage is provided at a third output of the bandgap reference circuit;

a tunable current source coupled to the divider circuit and configured to generate a tunable current reference at a fourth output of the bandgap reference circuit based, at least in part, on the divider circuit; and an amplifier stage having a first input coupled to the first transistor, a second input coupled to the common control node, and an output coupled to a common drain stage, wherein the tunable current source is coupled to a first terminal of the common drain stage and the divider circuit is coupled to a second terminal of the common drain stage at which the reference voltage is provided.

2. The bandgap reference circuit of claim 1, wherein the divider circuit comprises a resistor ladder coupled between the first output of the bandgap reference circuit and a reference potential and having an intermediate node at which the divided reference voltage is provided.

3. The bandgap reference circuit of claim 2, wherein the divider circuit further comprises at least one resistor coupled in parallel with the resistor ladder.

4. The bandgap reference circuit of claim 3, wherein the resistor ladder comprises at least two resistors having a temperature coefficient of a first polarity and wherein the at least one parallel-coupled resistor has a temperature coefficient of a second polarity.

5. The bandgap reference circuit of claim 4, wherein one of the at least two resistors of the resistor ladder or the at least one parallel-coupled resistor comprises an n-type resistor, and the other one of the at least two resistors of the resistor ladder and the at least one parallel-coupled resistor comprises a p-type resistor.

6. The bandgap reference circuit of claim 4, wherein at least one of the at least two resistors of the resistor ladder and the at least one parallel-coupled resistor includes a variable resistor, and wherein a current level of the tunable current reference is tunable by selection of a resistance associated with the variable resistor.

7. The bandgap reference circuit of claim 3, wherein a current level of the tunable current reference is tunable by selection of a resistance associated with the resistor ladder and a resistance associated with the at least one parallel-coupled resistor, and wherein a temperature coefficient of the tunable current reference is tunable by adjusting a ratio of the resistance associated with the resistor ladder with respect to the resistance associated with the at least one parallel-coupled resistor.

8. The bandgap reference circuit of claim 7, wherein the current level of the tunable current reference is substantially flat over temperature and a supply voltage.

9. The bandgap reference circuit of claim 1, wherein the common drain stage comprises a field effect transistor (FET).

10. A method of generating a tunable current with a bandgap circuit, comprising:

providing a bandgap reference voltage;

dividing the bandgap reference voltage with a resistor ladder comprising at least two resistors of a first resistor type;

coupling at least one resistor in parallel with the resistor ladder, wherein the at least one parallel-coupled resistor is of a second resistor type, different than the first resistor type;

providing a current reference; and tuning a current level of the current reference to be substantially flat over temperature and a supply voltage by selection of a resistance associated with the resistor ladder and a resistance associated with the at least one parallel-coupled resistor, and tuning a temperature coefficient of the current reference by adjusting a ratio of the resistance associated with the resistor ladder with respect to the resistance associated with the at least one parallel-coupled resistor.

11. The method of claim 10, wherein dividing the bandgap reference voltage with a resistor ladder comprising at least two resistors of a first resistor type comprises dividing the bandgap reference voltage with a resistor ladder comprising at least two resistors having a temperature coefficient of a first polarity.

12. The method of claim 11, wherein coupling at least one resistor in parallel with the resistor ladder comprises coupling at least one resistor having a temperature coefficient of a second polarity in parallel with the resistor ladder.

13. The method of claim 10, wherein one of the at least two resistors of the resistor ladder or the at least one parallel-coupled resistor comprises an n-type resistor, and the other one of the at least two resistors of the resistor ladder and the at least one parallel-coupled resistor comprises a p-type resistor.

14. A bandgap reference circuit, comprising:

a voltage reference circuit comprising a first transistor having a first junction voltage and a second transistor having a second junction voltage, wherein the voltage reference circuit is configured to generate a reference voltage at a common control node coupled to the first and second transistors, the reference voltage based, at least in part, on a voltage difference between the first junction voltage and the second junction voltage, wherein the reference voltage is provided at a first output of the bandgap reference circuit;

a proportional to absolute temperature (PTAT) current source configured to generate a PTAT current reference at a second output of the bandgap reference circuit based, at least in part, on a current through the first transistor;

a divider circuit coupled to the reference voltage and configured to generate a divided reference voltage having a voltage value that is a fraction of a voltage value of the reference voltage, wherein the divided reference voltage is provided at a third output of the bandgap reference circuit; and a tunable current source coupled to the divider circuit and configured to generate a tunable current reference at a fourth output of the bandgap reference circuit based, at least in part, on the divider circuit, wherein the current level of the tunable current reference is substantially flat over temperature and a supply voltage.

15. The bandgap reference circuit of claim 14, further comprising an amplifier stage having a first input coupled to the first transistor, a second input coupled to the common control node, and an output coupled to a common drain stage, wherein the tunable current source is coupled to a first terminal of the common drain stage and the divider circuit is coupled to a second terminal of the common drain stage at which the reference voltage is provided.

16. The bandgap reference circuit of claim 15, wherein the divider circuit comprises a resistor ladder coupled between the first output of the bandgap reference circuit and a reference potential and having an intermediate node at which the divided reference voltage is provided.

17. The bandgap reference circuit of claim 16, wherein the divider circuit further comprises at least one resistor coupled in parallel with the resistor ladder and wherein the resistor ladder comprises at least two resistors having a temperature coefficient of a first polarity and wherein the at least one parallel-coupled resistor has a temperature coefficient of a second polarity.

18. The bandgap reference circuit of claim 17, wherein a current level of the tunable current reference is tunable by selection of a resistance associated with the resistor ladder and a resistance associated with the at least one parallel-coupled resistor, and wherein a temperature coefficient of the tunable current reference is tunable by adjusting a ratio of the resistance associated with the resistor ladder with respect to the resistance associated with the at least one parallel-coupled resistor.

* * * * *